United States Patent [19]

Nakamura et al.

[11] Patent Number: 5,058,196

[45] Date of Patent: Oct. 15, 1991

[54] ELECTRIC INFRARED HEATER HAVING A GAS PERMEABLE ELECTROFORMED POROUS METALLIC PANEL COATED WITH A POROUS CERAMIC FAR-INFRARED RADIATING LAYER

[75] Inventors: Kisaku Nakamura, Funabashi; Shigeru Okuyama, Kashiwa; Eiji Owada, Tsuchiura; Yoshihiro Nishibori, Funabashi, all of Japan

[73] Assignee: Senju Metal Industry Co., Ltd., Tokyo, Japan

[21] Appl. No.: 352,227

[22] Filed: May 15, 1989

Related U.S. Application Data

[63] Continuation of Ser. No. 156,632, Feb. 17, 1988, abandoned.

[30] Foreign Application Priority Data

Feb. 17, 1987 [JP] Japan ..... 62-20683[U]
Dec. 23, 1987 [JP] Japan ..... 62-195583[U]

[51] Int. Cl.[5] ..... F28F 13/18; H05B 3/00

[52] U.S. Cl. ..... 392/435; 126/91 R; 165/133; 392/408; 392/410; 392/418; 392/432

[58] Field of Search ..... 219/377, 343, 354, 345, 219/553; 126/91, 92 R, 92 AC, 91 R, 9; 156/497; 392/407, 432, 435, 408, 418; 165/133

[56] References Cited

U.S. PATENT DOCUMENTS

| | | | |
|---|---|---|---|
| 2,573,121 | 10/1951 | Wandelt | 219/345 |
| 3,077,531 | 2/1963 | Wompey | 219/377 |
| 3,087,041 | 4/1963 | Vonk | 219/347 |
| 3,496,332 | 2/1970 | Lumde | 156/497 X |
| 3,539,770 | 11/1970 | Wallace | 219/345 |
| 3,668,370 | 6/1972 | Pattison | 219/373 |
| 3,816,705 | 6/1974 | Ebert | 219/343 X |
| 4,164,642 | 8/1979 | Ebert | 219/354 X |
| 4,263,500 | 4/1981 | Springer et al. | 219/377 |
| 4,626,659 | 12/1986 | Charmes et al. | 219/343 |
| 4,798,192 | 1/1989 | Maruko | 126/91 A |

FOREIGN PATENT DOCUMENTS

| | | | |
|---|---|---|---|
| 2446444 | 9/1980 | France | 219/347 |
| 44-16225 | 7/1969 | Japan | 219/377 |
| 44-16226 | 7/1969 | Japan | 219/377 |
| 56-85619 | 7/1981 | Japan | 219/377 |
| 85022 | 5/1983 | Japan | 219/377 |
| 59-205531 | 11/1984 | Japan | 126/391 |
| 841913 | 11/1958 | United Kingdom . | |
| 921234 | 7/1961 | United Kingdom . | |
| 1031659 | 4/1965 | United Kingdom . | |
| 1105135 | 3/1968 | United Kingdom . | |
| 1182048 | 2/1970 | United Kingdom . | |
| 2136549 A | 9/1984 | United Kingdom . | |

*Primary Examiner*—Anthony Bartis
*Attorney, Agent, or Firm*—Sughrue, Mion, Zinn Macpeak & Seas

[57] ABSTRACT

An electric far-infrared heater has a plate-like porous metallic panel formed by an electroforming process installed in a box-like housing over an electric heating element therein. The panel is heated by the element and has its outer surface covered by a porous ceramic far-infrared emitting layer of $Al_2O_3$, $TiO_2$, $Cr_2O_3$, MgO, $ZrO_2$, $SiO_2$ or mixtures thereof. A stream of gas supplied to the interior of the housing is heated by the element and passes through the porous panel and far-infrared layer for discharge onto the object being heated.

7 Claims, 2 Drawing Sheets

ELECTRIC INFRARED HEATER HAVING A GAS PERMEABLE ELECTROFORMED POROUS METALLIC PANEL COATED WITH A POROUS CERAMIC FAR-INFRARED RADIATING LAYER

This is a continuation of application Ser. No. 07/156,632 now abandoned.

BACKGROUND OF THE INVENTION

This invention relates to an infrared heater, and more particularly to an infrared heater which emits far-infrared rays in a wave range of 3 μm or longer for use in effecting reflowing of solder, curing of resins, drying of food, heating of wood and wet coatings, warming for medical treatment, and the like.

Recently, there is a general trend for electronic equipment to be made increasingly compact and light weight. Accordingly, printed circuit boards having a large number of electronic parts mounted in a limited area (hereunder referred to as "high-density mounted boards" or "high-density mounted printed circuit boards") are widely used. In the manufacture of high-density mounted boards, it is necessary to supply heat to a narrow area between electronic parts on the high-density mounted board in order to reflow a paste solder or to cure an adhesive resin when the electronic parts are connected to the circuit board using a paste solder or a resinous bonding agent. As an industrial heating apparatus for these purposes, a reflowing furnace is used in which infrared heaters are placed on the top and bottom walls of a tunnel-type heating zone. The infrared heater used in the reflowing furnace comprises a sheath heater, or a mere heater supported by a steel plate. The radiation wavelength is not longer than 3 μm.

Since infrared rays travel in straight lines, the electronic parts on the high-density mounted board prevent the infrared rays from directly reaching the area where solder or adhesive resin was previously placed. Thus, sometimes the reflowing of a paste solder or the curing of a bonding agent is not sufficient to effect bonding of the electronic parts to the circuit board.

In addition, infrared rays having a maximum wavelength of 3 μm, which are produced by conventional infrared heaters, e.g., infrared lamps for use in a reflowing furnace, are not well absorbed by white objects, especially by a metal such as solder. Therefore, in order to thoroughly melt the solder in a reflowing furnace, it is necessary to increase the amount of heat to be generated by a heating element by increasing the electric current density of the sheath heater. Unfortunately, since infrared rays of a wavelength of 3 μm or shorter are easily absorbed by black objects, and electronic parts usually have a black exterior, the electronic parts are preferentially heated. Thus, when the temperature is increased in order to efficiently heat the paste solder or bonding agent, e.g., by increasing the current denisty as described above, the electronic parts are inevitably further heated, resulting in thermal damage which can produce the malfunction of the parts.

SUMMARY OF THE INVENTION

An object of the present invention is to provide an infrared heater which can thoroughly heat narrow areas between electronic parts on high-density mounted printed circuit boards, andd which emits infrared rays which can easily be absorbed by a paste solder and a bonding agent.

The inventors of the present invention have found that a combination of a heated stream of gas with infrared rays can efficiently heat an object, and that the employment of a ceramic layer through which gas can pass and which emits infrared rays when heated can produce a synergistic effect which enables the attainment of the above-mentioned object of the present invention.

Thus, the present invention is an infrared heater which comprises an electric heating element installed in a box-type housing, an infrared-radiating layer placed over the heating element, the infrared-radiating layer emitting infrared rays when heated and a stream of gas being able to pass through the layer, and a gas-supplying means provided in the housing through which a stream of gas is supplied into the housing, the gas supplied through the means into the housing being discharged through the infrared-radiating layer.

The infrared-radiating layer comprises a ceramic layer through which gas can pass and which is able to emit infrared rays when heated.

The gas-supplying means may be a gas inlet which is connected to a source of pressurized gas.

In another embodiment, the gas-supplying means comprises a fan disposed behind the electric heating element. A stream of gas which is supplied from a suitable source or from the surroundings through an opening provided behind the fan and then is heated by the electric heating element is blown through the ceramic layer onto a circuit board. Any type of a fan may be employed as long as it can generate a stream of gas by means of rotating members.

Since the gas-suplying means is installed behind the electric heating element within the housing, it is preferred that the gas-supplying means be of high power, but it is also desirable that it be as compact as possible.

The ceramic layer which can emit far-infrared rays when heated can be made of $Al_2O_3$, $TiO_2$, $Cr_2O_3$, MgO, $ZrO_z$, $SiO_z$, and the like. The base porous plate to support the ceramic layer may be a perforated plate manufactured by an electroforming process. The ceramic layer may be manufactured by means of baking or flame spraying a ceramic onto the base porous plate through which a stream of gas can pass.

In still another embodiment, a gas-permeable ceramic panel or cover may be disposed over the electric heating element like a roof.

Thus, according to the present invention, a stream of gas which is heated when passing through the housing is blown onto an object after further being heated when passing through the ceramic layer. The heated gas which is discharged from the heater can easily enter narrow areas which infrared rays cannot reach. In addition, the infrared rays emitted from the ceramic layer have wavelengths of 3 μm or longer, which can be entirely absorbed by a metal or white object. The employment of a heated stream of gas as well as infrared rays produces a synergistic effect when heating a paste solder or bonding agent which has been applied to a high-density mounted printed circuit board.

, DESCRIPTION OF THE PREFERRED EMBODIMENTS

Figure 3:
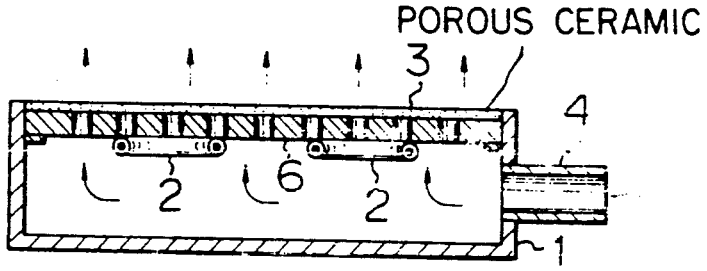
FIG. 3 is a cross-sectional view of a second embodiment.
Figure 4:
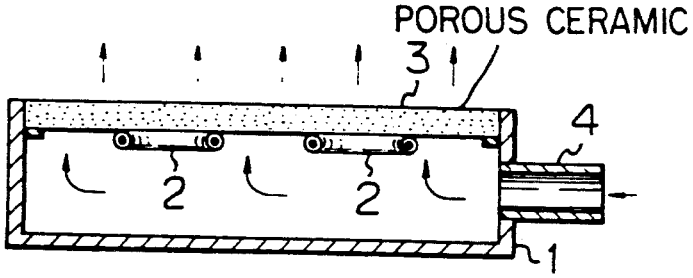
FIG. 4 is a cross-sectional view of a third embodiment.
Figure 5:
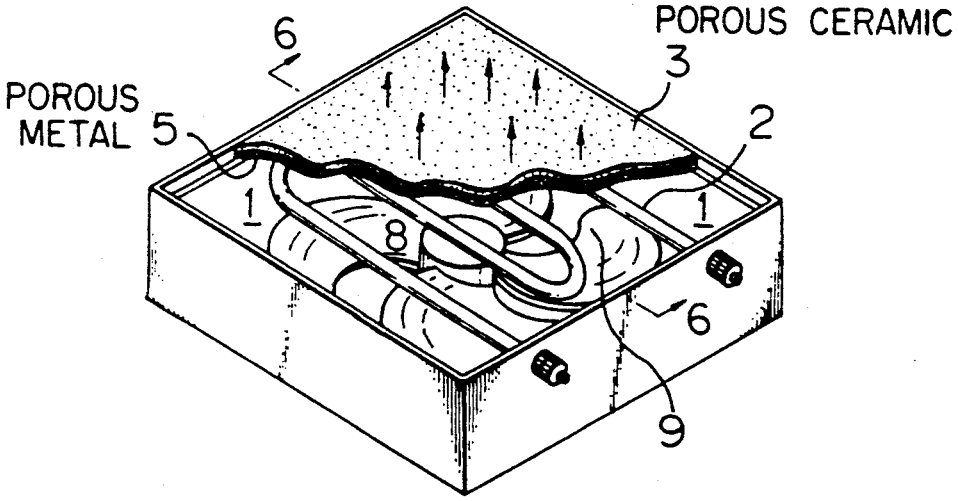
FIG. 5 is a cut-away perspective view of yet another embodiment of the present invention.
Figure 6:
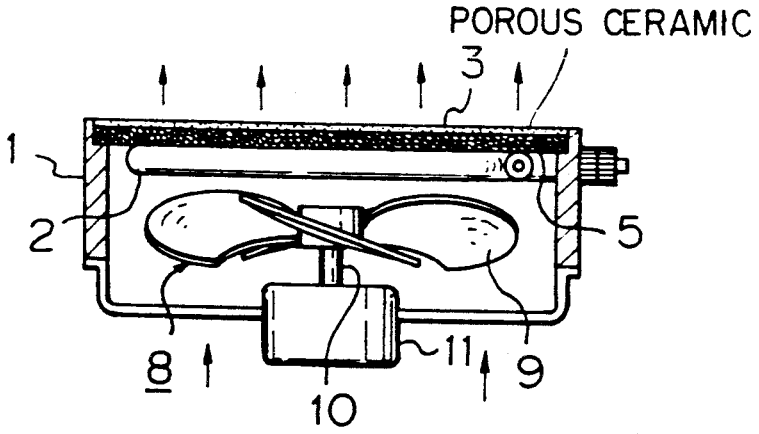
FIG. 6 is a partially cross-sectional side view of FIG. along section line 6—6.

The infrared heater of the present invention shown in the drawings comprises a box-type housing 1, an electric heating element 2, an infrared-radiating member in the form of a ceramic layer 3, and a gas-supplying means which is represented by a gas inlet 4 in FIGS. 1 through 4 and by a fan 8 in FIGS. 5 and 6.

Figure 1:
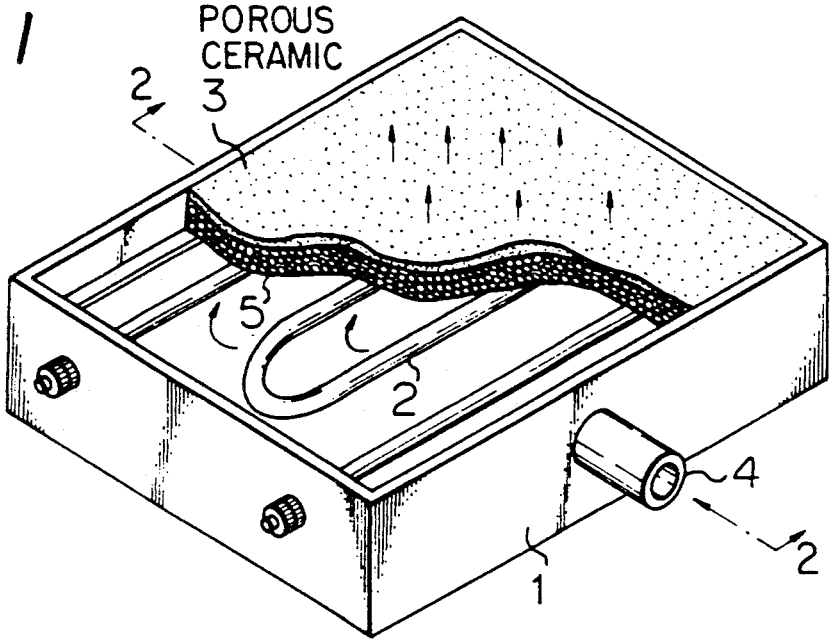
FIG. 1 is a cut-away perspective view of a first embodiment of the present invention.
Figure 2:
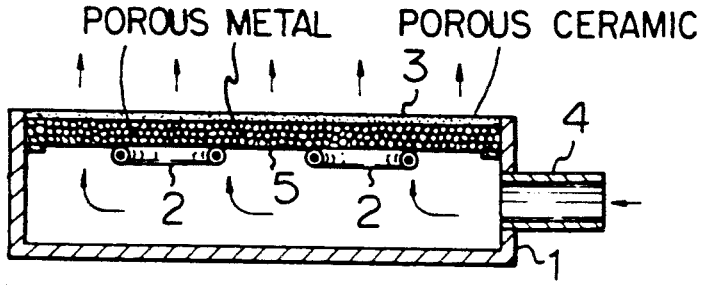
FIG. 2 is a cross-sectional view of FIG. 1 along section line 2—2.

FIGS. 1 and 2 are respectively a perspective view and a sectional view of a first embodiment of the present invention. Within the housing 1, a sheath-type electric heating element 2 of the sheath type horizontally lies in a zigzag line. The ceramic layer 3 is supported over the heating element 2 by a porous metallic supporting member 5. The porous metallic supporting member 5 through which a stream of gas can pass freely includes a porous sintered metal plate which is produced by sintering metal powders, a perforated metal plate manufactured by an electroforming process (commercially available under the tradename of "Celmet"), a punched metal plate which is manufactured by mechanically punching a large number of holes in a metal plate, or the like. Any type of porous plate can be employed so long as a stream of gas can easily pass through it. In light of its function as a support for the ceramic layer and the gas-permeability required thereof, a perforated metal plate manufactured by an electroforming process is preferred.

The porous ceramic layer 3 may be one through which a stream of gas can pass easily. The porous ceramic layer may be formed atop the porous metallic supporting member by means of baking or flame spraying of ceramics.

The gas inlet 4 is positioned on either side or on the bottom of the housing 1 and is connected to a compressor or a pressurized gas container (not shown) so that a stream of gas can pass through the housing in the direction shown by the arrows.

FIG. 3 shows a second embodiment of the present invention, in which a perforated metal plate 6 having a large number of holes therein is disposed over the heating element 2, and the porous ceramic layer 3 in the form of a plate is positioned thereon.

FIG. 4 shows a third embodiment of the present invention, in which the porous ceramic layer 3 is placed over the electric heating element 2 without any intervening member.

FIGS. 5 and 6 show still another embodiment of the present invention, in which the gas-supplying means is provided behind the electric heating element 2. In the illustrated example, the gas-supplying means is a fan 8 having rotating members in the form of blades 9. A drive shaft 10 is connected to a motor 11. As long as the gas-supplying means 8 is positioned behind the heating element 2, there is no restriction on its position or the manner of fixing it to the housing.

The operation of the infrared heater of the present invention will be described with reference to the drawings.

At first, an electric current is passed through the electric heating element 2. When the element 2 is heated, the metallic supporting member 5 and ceramic layer 3 are heated. The ceramic layer comprises the porous, infrared-radiating surface, and is disposed over the heating element 2. Simultaneously, the box-type housing 1 within which the heating element 2 is placed is also heated by the element 2.

After all the components around the heating element 2 are heated to a high temperature, a blower which is illustrated as a rotating fan and which is installed behind the electric heating element 2 is actuated, and a stream of gas is forced to pass through the heater as shown in FIGS. 5 and 6. Alternatively, as shown in FIGS. 1 through 4, the box-type housing 1 may be sealed, and a gas inlet 4 may be provided to supply a gas such as air or an inert gas ($N_2$, $CO_2$, Ar, He) to the inside of the housing 1. Due to the provision of such a gas-supplying means, a stream of gas is heated within the housing and is further heated when it passes through the porous metallic supporting member 5 and the ceramic layer 3 to provide a hot gas stream at a temperature, e.g. 150°~350° C.

Thus, according to the infrared heater of the present invention, far-infrared rays having a wavelength of 3 μm or longer are emitted from the heated ceramic layer 3 and a hot stream of gas is discharged therefrom.

In the case where the infrared heater is installed in a reflowing furnace to heat a high-density mounted printed circuit board to which a paste solder or a bonding agent has been applied, since far-infrared rays having a wavelength of 3 μm or longer which are efficiently absorbed by metal or resins are emitted from the ceramic layer, the paste solder or bonding agent is efficiently heated. Simultaneously, a hot stream of gas which has passed through the porous structure of the ceramic layer can easily reach areas between the electronic parts on the high-density mounted printed circuit board, which can not be reached by infrared rays.

Therefore, the infrared heater of the present invention can take advantage of far-infrared radiation and of a hot stream of gas, which together produce a synergistic effect when performing bonding with a paste solder or bonding agent.

The present invention has been described primarily with respect to an example in which the infrared heater of the present invention is used as a heat source in a reflowing furnace. However, as is apparent from the foregoing, the heater of the present invention is useful for a variety of applications, including curing of resins, drying of food, heating of wood and wet coatings, and warming for medical treatment.

We claim:

1. A far-infared heater which comprises an electric heating element installed in a box-type housing having an open side, a porous far-infared-radiating layer in contact with and supported by a plate-like porous metallic supporting member manufactured by an electroforming process, positioned over said heating element and covering said open side of said housing, said far-infared-radiating layer emitting far-infared rays having a wavelength of at least 3 μm when heated and being capable of passing a stream of gas through said layer, and a gas-supplying means provided in said housing through which a gas stream is supplied to the inside of the housing, the gas supplied through said gas-supplying means into the housing being discharged through the porous supporting member and the far-infared-radiating layer.

2. An infrared heater as defined in claim 1, in which the infrared-radiating layer comprises a ceramic layer through which a stream of gas can pass.

3. An infrared heater as defined in claim 2, in which the ceramic layer is made of a material selected from the group consisting of $Al_2O_3$, $TiO_2$, $Cr_2O_3$, MgO, $ZrO_2$, $SiO_2$, and mixtures thereof.

4. An infrared heater as defined in claim 1, in which the gas-supplying means is a gas inlet which is connected to a source of pressurized gas.

5. A far-infared heater which comprises an electric heating element installed in a box-type housing having an open side, a porous far infared-radiating layer in contact with and supported by a plate-like porous metallic supporting member manufactured by an electroforming process, positioned over said heating element and covering said open side of said housing, said far-infared-radiating layer emitting far-infared rays having a wavelength of at least 3 μm when heated and being capable of passing a stream of gas through said layer, and a gas-supplying means provided in said housing through which a gas stream is supplied to the inside of the housing, the gas supplied through said gas-supplying means into the housing being discharged through the porous supporting member and the far-infared-radiating layer and the gas-supplying means comprising a far disposed behind the electric heating element.

6. An infrared heater as defined in claim 5, in which the infrared-radiating layer comprises a ceramic layer through which a stream of gas can pass.

7. An infrared heater as defined in claim 6, in which the ceramic layer is made of a material selected from the group consisting of $Al_2O_3$, $TiO_2$, $Cr_2O_3$, MgO, $ZrO_2$, $SiO_2$, and mixtures thereof.

* * * * *

UNITED STATES PATENT AND TRADEMARK OFFICE

CERTIFICATE OF CORRECTION

PATENT NO. : 5,058,196

DATED : October 15, 1991

INVENTOR(S) : Kisaku Nakamura, et al

It is certified that error appears in the above-indentified patent and that said Letters Patent is hereby corrected as shown below:

In column 6, line nine, delete "far" and insert therefor --fan--.

Signed and Sealed this

Twenty-ninth Day of June, 1993

*Attest:*

*Attesting Officer*

Michael K. Kirk

MICHAEL K. KIRK

*Acting Commissioner of Patents and Trademarks*